US007025041B2

(12) United States Patent
Abe et al.

(10) Patent No.: US 7,025,041 B2
(45) Date of Patent: Apr. 11, 2006

(54) CYLINDER INTAKE AIR QUANTITY DETERMINATION DEVICE

(75) Inventors: Kazuhiko Abe, Kawasaki (JP); Hatsuo Nagaishi, Zushi (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/030,200

(22) Filed: Jan. 7, 2005

(65) Prior Publication Data

US 2005/0178361 A1 Aug. 18, 2005

(30) Foreign Application Priority Data

Feb. 18, 2004 (JP) ..... 2004-041888

(51) Int. Cl.
*F02M 15/00* (2006.01)

(52) U.S. Cl. ..... 123/432; 123/435

(58) Field of Classification Search ..... 123/432, 123/434, 435; 73/118.2; 701/103
See application file for complete search history.

(56) References Cited

U.S. PATENT DOCUMENTS 4,962,739 A * 10/1990 Wataya ..... 123/435
5,635,634 A 6/1997 Reuschenbach et al.
6,122,589 A * 9/2000 Yamaguchi et al. ..... 701/106
6,328,007 B1 12/2001 Hirasawa et al.
6,564,785 B1 5/2003 Iwasaki

FOREIGN PATENT DOCUMENTS

| | | | |
|---|---|---|---|
| DE | 10332107 | A1 | 1/2004 |
| EP | 1329624 | A | 7/2003 |
| JP | 2001-50091 | A | 2/2001 |
| JP | 2002-371894 | A | 12/2002 |
| JP | 2004-108262 | A | 4/2004 |

* cited by examiner

*Primary Examiner*—Mahmoud Gimie
(74) *Attorney, Agent, or Firm*—Shinjyu Global IP Counselors, LLP

(57) ABSTRACT

A cylinder intake air quantity determination device is configured to calculate a manifold internal air quantity based on an inflow air quantity and an outflow air quantity of an intake manifold. Then, a manifold internal pressure is calculated based on the manifold internal air quantity and an intake air temperature, and a cylinder internal pressure corresponding to a crank angle is calculated based on the previous cylinder intake air quantity. The cylinder intake air quantity is then calculated based on the manifold internal pressure, the cylinder internal pressure, and the intake air temperature. Thus, the cylinder intake air quantity determination device is configured to calculate the cylinder intake air quantity with a good precision.

14 Claims, 4 Drawing Sheets

CYLINDER INTAKE AIR QUANTITY DETERMINATION DEVICE

CROSS-REFERENCE TO RELATED APPLICATIONS

This application claims priority to Japanese Patent Application No. 2004-041888. The entire disclosure of Japanese Patent Application No. 2004-041888 is hereby incorporated herein by reference.

BACKGROUND OF THE INVENTION

1. Field of the Invention

The present invention generally relates to a cylinder intake air quantity determination device for an internal combustion engine. More specifically, the present invention relates to a cylinder intake air quantity determination device that is configured and arranged to calculate a cylinder intake air quantity with good precision based on a manifold internal pressure and a cylinder internal pressure.

2. Background Information

Japanese Laid-Open Patent Publication No. 2001-50091 discloses a cylinder intake air quantity determination device for a variable valve timing control internal combustion engine. The cylinder intake air quantity determination device disclosed in this reference is configured to calculate an amount of air inside an intake manifold by computing a balance between an amount of air flowing into the intake manifold and an amount of air flowing out of the intake manifold which corresponds to a cylinder intake air quantity flowing from the manifold to the cylinder computed in a previous control routine. Then, the cylinder intake air quantity determination device of this reference is configured to compute a current cylinder intake air quantity based on the amount of air inside the manifold and a cylinder volume that is corrected based on a volume of the cylinder when an intake valve is closed.

Japanese Laid-Open Patent Publication No. 2002-371894 discloses another example of a cylinder intake air quantity determination device for an internal combustion engine. In this reference, a mass air quantity inside an intake manifold is calculated by computing a balance between an amount of air flowing into the intake manifold and an amount of air flowing out of the intake manifold. Then, a cylinder intake mass air quantity flowing into a cylinder is calculated. Moreover, in the cylinder intake air quantity determination device disclosed in this reference, the mass air quantity inside the intake manifold is corrected to remove a superfluous air amount to obtain a mass air quantity inside the intake manifold when the engine is stopped. Then, this corrected mass air quantity inside the intake manifold is used to calculate an initial value for a mass air quantity inside the intake manifold when the engine is restarted.

In view of the above, it will be apparent to those skilled in the art from this disclosure that there exists a need for an improved cylinder intake air quantity determination device. This invention addresses this need in the art as well as other needs, which will become apparent to those skilled in the art from this disclosure.

SUMMARY OF THE INVENTION

With the cylinder intake air quantity devices discussed in the above mentioned references, the cylinder intake air quantity is calculated by assuming the cylinder pressure is a constant value. However, when a variable valve timing system is involved, a pressure inside the intake manifold varies during low valve lift operation, during advanced or delayed valve closing timing operation. In such cases, there may be errors in the calculation results for the cylinder intake air quantity.

The present invention was conceived to solve this problem. Thus, one object of the present invention is to calculate the cylinder intake air quantity more precisely. In accordance with one aspect of the present invention, a cylinder intake air quantity determination device is provided that basically comprises a manifold internal air quantity calculation section, a manifold internal pressure calculation section, a cylinder internal pressure calculation section and a cylinder intake air quantity calculation section. The manifold internal air quantity calculation section is configured to calculate a manifold internal air quantity based on a balance between an air quantity flowing into an intake manifold and an air quantity flowing out of the intake manifold. The manifold internal pressure calculation section is configured to calculate a manifold internal pressure based at least on the manifold internal air quantity. The cylinder internal pressure calculation section is configured to calculate a cylinder internal pressure based on at least one parameter that affects a vapor state inside a cylinder. The cylinder intake air quantity calculation section is configured to calculate a cylinder intake air quantity based on the manifold internal pressure and the cylinder internal pressure.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
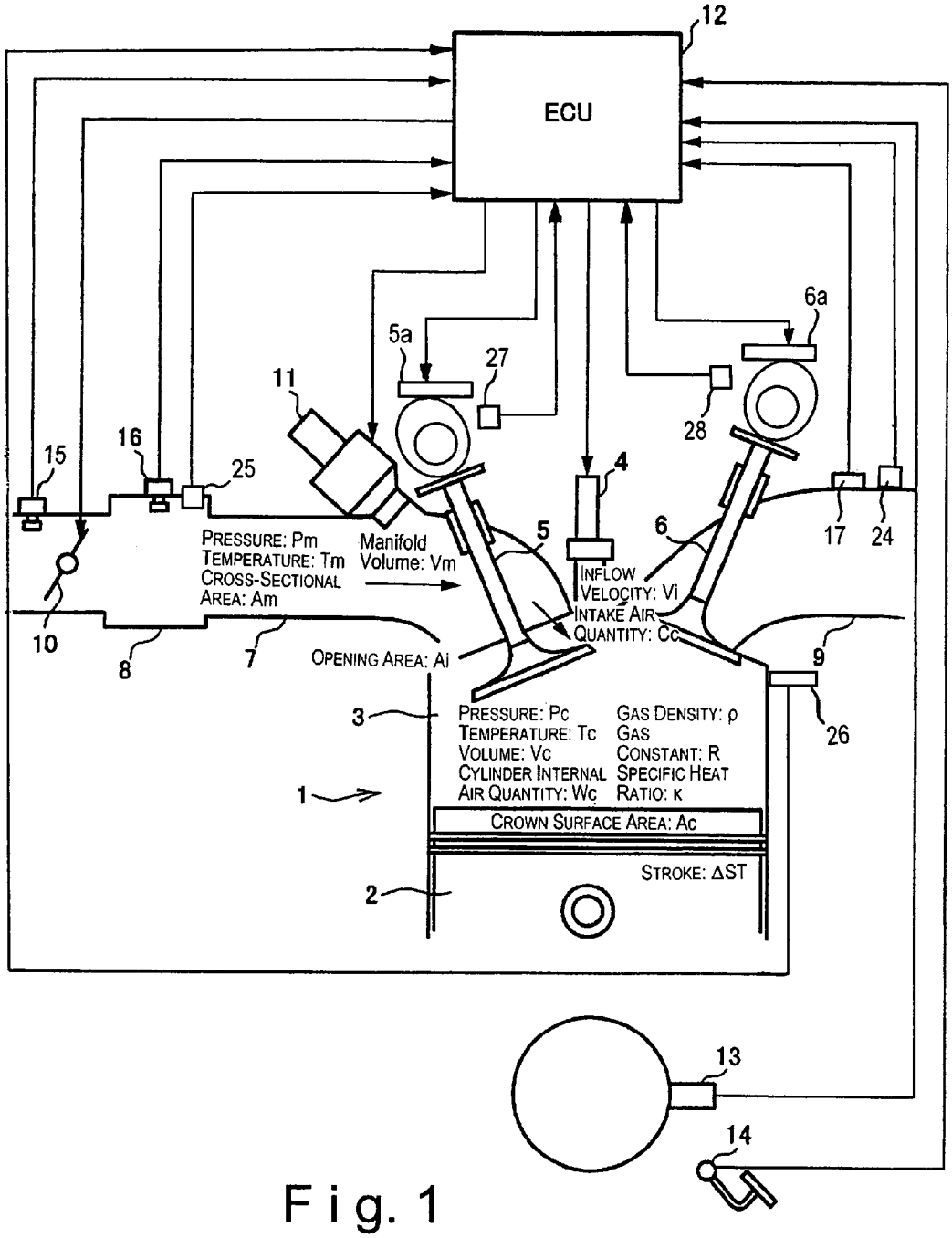
FIG. 1 is a schematic diagram of an internal combustion engine with a cylinder intake air quantity determination device in accordance with a preferred embodiment of the present invention.

Referring initially to FIG. 1, an internal combustion engine 1 with a cylinder intake air quantity determination device is illustrated in accordance with a preferred embodiment of the present invention. FIG. 1 is a schematic diagram of the internal combustion engine 1. For a better understanding of the present invention, various parameters used for calculating a cylinder intake air quantity are shown in FIG. 1.

As seen in FIG. 1, the internal combustion engine 1 includes a plurality of combustion chambers (only one combustion chamber is shown) formed by a plurality of pistons 2 (only one piston is shown) and a plurality of cylinders 3 (only one cylinder is shown) of the internal combustion engine 1, respectively. Each combustion chamber is preferably equipped with an electromagnetically driven intake valve 5 and an electromagnetically driven exhaust valve 6, and a spark plug 4 disposed between the intake valve 5 and the exhaust valve 6. Moreover, the internal combustion engine 1 includes a plurality of intake air passages 7 coupled to the combustion chambers, an intake manifold 8 installed along the intake air passages 7, and a plurality of exhaust air passages 9. Thus, it will be apparent to those skilled in the art from this disclosure that the cylinder intake air quantity determination device of the present invention applies to a multi-cylinder engine even though the following description of the cylinder intake air quantity determination device of the present invention refers only to one cylinder or combustion chamber.

The intake valve 5 and the exhaust valve 6 are preferably controlled by electromagnetic variable valve timing devices 5*a* and 6*a*, respectively. The variable valve timing devices 5*a* and 6*a* are configured and arranged to variably control lift amount and opening/closing timing of the intake valve 5 and the exhaust valve 6, respectively. Of course, it will be apparent to those skilled in the art from this disclosure that the variable valve timing control of the intake valve 5 and the exhaust valve 6 is not limited to be performed by the electromagnetic variable valve timing devices 5*a* and 6*a* illustrated in FIG. 1. For example, the internal combustion engine 1 can be configured and arranged to include a mechanical variable valve timing mechanism equipped with cams and lifters so that the lift amount and the opening/closing timing of the intake valve 5 and the exhaust valve 6 are controlled as desired by the mechanical variable valve timing mechanism. The electromagnetic variable valve timing devices 5*a* and 6*a* and the mechanical variable valve timing mechanism are conventional components that are well known in the art. Since the electromagnetic variable valve timing devices 5*a* and 6*a* and the mechanical variable valve timing mechanism are well known in the art, these structures will not be discussed or illustrated in detail herein.

An electrical throttle valve 10 is provided to the intake air passage 7 at an upstream position of the intake manifold 8. The intake air passage 7 is also preferably provided with an electromagnetic fuel injector valve 11 at an intake port portion of the cylinder 3 as seen in FIG. 1.

The internal combustion engine 1 further includes an ECU or engine control unit 12 configured and arranged to control the operation of the spark plug 4, the variable valve timing devices 5*a* and 6*a*, the electrical throttle valve 10, the fuel injector valve 11 and other components of the internal combustion engine 1.

In the present invention, the control unit 12 preferably includes a microcomputer with a cylinder intake air quantity calculation control program that controls the calculation of the cylinder intake air quantity as discussed below. The control unit 12 can also include other conventional components such as an input interface circuit, an output interface circuit, and storage devices such as a ROM (Read Only Memory) device and a RAM (Random Access Memory) device. The microcomputer of the control unit 12 is programmed to control the various components of the internal combustion engine 1. The memory circuit stores processing results and control programs such as ones for the cylinder intake air quantity calculation operation that are run by the processor circuit. The control unit 12 is operatively coupled to the various components of the internal combustion engine 1 in a conventional manner. The internal RAM of the control unit 12 stores statuses of operational flags and various control data. The internal ROM of the control unit 12 stores data for various operations. The control unit 12 is capable of selectively controlling any of the components of its control system in accordance with the control program. It will be apparent to those skilled in the art from this disclosure that the precise structure and algorithms for the control unit 12 can be any combination of hardware and software that will carry out the functions of the cylinder intake air quantity determination device of the present invention. In other words, "means plus function" clauses as utilized in the specification and claims should include any structure or hardware and/or algorithm or software that can be utilized to carry out the function of the "means plus function" clause.

Moreover, the control unit 12 is configured and arranged to receive input signals from a crank angle sensor 13, an accelerator pedal sensor 14, a hot-wire air flow meter 15, a temperature sensor 16, an exhaust pressure sensor 17, and the like. The crank angle sensor 13 is configured and arranged to output a crank angle signal synchronized to engine revolution to the control unit 12 to detect an engine speed Ne and the crank angle position Ca. The accelerator pedal sensor 14 is configured and arranged to detect an accelerator opening degree (how much the accelerator pedal is depressed) and produce an output signal indicative of the accelerator opening degree, which is sent to the control unit 12. The hot-wire air flow meter 15 is configured and arranged to detect an air flow quantity Qa (mass flow; g) in the intake passage 7 from the electrical throttle valve 10 to an upstream portion of the intake manifold 8 and produce an output signal indicative of the air flow quantity Qa, which is sent to the control unit 12. The temperature sensor 16 is configured and arranged to detect an intake air temperature Tm (K) inside the intake manifold 8 and produce an output signal indicative of the intake air temperature Tm, which is sent to the control unit 12. The exhaust pressure sensor 17 is configured and arranged to detect an exhaust pressure Pex (Pa) in the exhaust air passage 9 and produce an output signal indicative of the exhaust pressure Pex, which is sent to the control unit 12. Furthermore, the control unit 12 can be configured and arranged to receive input signals from an exhaust temperature sensor 24, an intake air pressure sensor 25, a water temperature sensor 26, and a pair of intake and exhaust cam angle sensors 27 and 28 as seen in FIG. 1.

The control unit 12 is configured and arranged to control the fuel injection timing and fuel injection quantity of the fuel injector valve 11 based on the engine operating conditions. More specifically, the control unit 12 is configured and arranged to control the fuel injection quantity to achieve a desired air-fuel ratio with respect to a cylinder intake air quantity Cc (air mass inside the cylinder 3), which is calculated based on the inflow air quantity (mass flow) Qa measured by the air flow meter 15 and other parameters as discussed in more detail below.

Moreover, the control unit 12 is configured and arranged to control the ignition timing of the spark plug 4 to achieve the MBT (e.g., ideal ignition timing for best torque) or at the knock limit based on the engine operating conditions.

Figure 2:
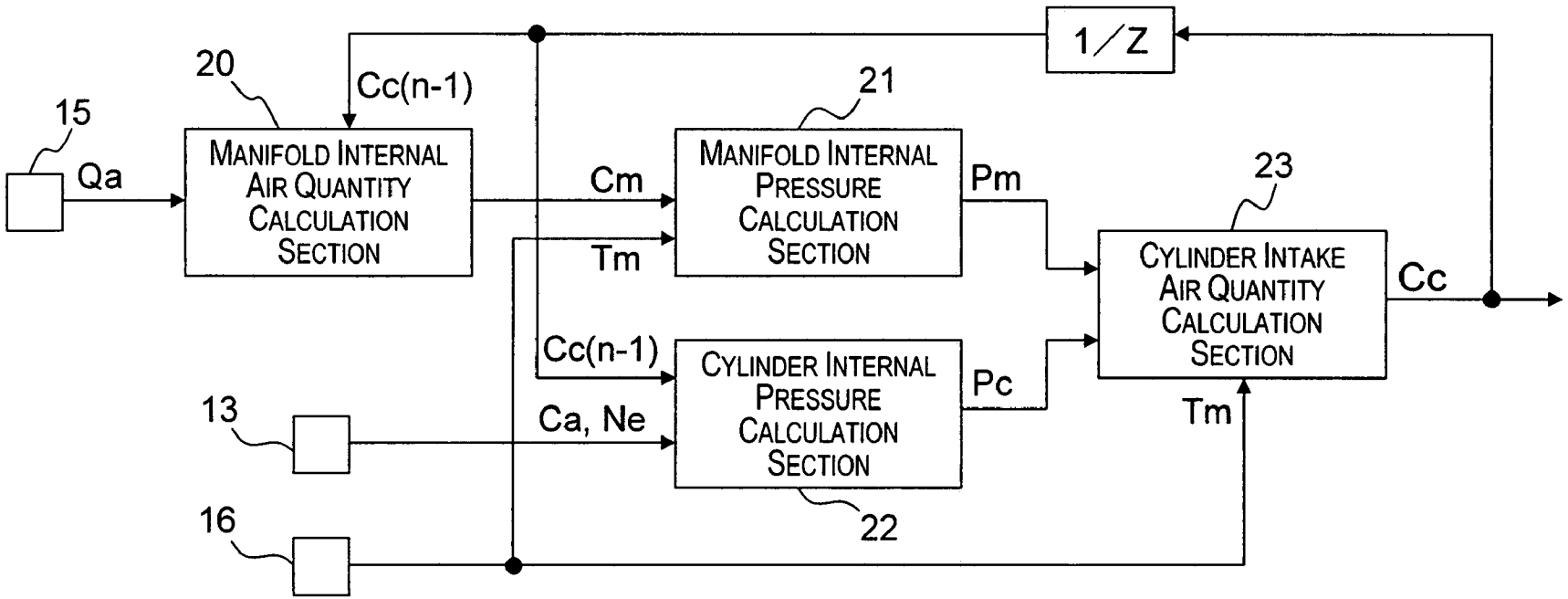
FIG. 2 is a control block diagram for calculating a cylinder intake air quantity in the cylinder intake air quantity determination device in accordance with the preferred embodiment of the present invention.

FIG. 2 is a control block diagram for explaining a calculation of the cylinder intake air quantity Cc (air mass quantity inside the cylinder 3) that is used for controlling the fuel injection quantity and so forth. The cylinder intake air quantity determination device of the present invention is configured and arranged to calculate the cylinder intake air quantity with a good precision when the cylinder intake air quantity changes such as when the valve timing changes or when there is a pressure difference between before and after the intake valve 5 during low valve lift operation.

The cylinder intake air quantity determination device of the present invention basically comprises a manifold internal model including a manifold internal air quantity calculation section 20 and a manifold internal pressure calculation section 21, and a cylinder internal model including a cylinder internal pressure calculation section 22 and a cylinder intake air quantity calculation section 23. Thus, the cylinder intake air quantity Cc of the internal combustion engine 1 is calculated by the manifold internal model and the cylinder internal model of the cylinder intake air quantity determination device.

The manifold internal air quantity calculation section 20 is configured and arranged to calculate a manifold internal air quantity Cm (g) based on a balance between the inflow air quantity Qa to the intake manifold 8 and an outflow air quantity (mass; g) from the intake manifold 8. As mentioned above, the inflow air quantity Qa to the intake manifold 8 is calculated based on the output signal from the air flow meter 15. The outflow air quantity from the intake manifold 8 is equal to a previous value of the cylinder intake air quantity Cc(n−1) calculated in a preceding control routine.

The manifold internal pressure calculation section 21 is configured and arranged to calculate a manifold internal pressure Pm (Pa) inside the intake manifold 8 based on the manifold internal air quantity Cm and the intake air temperature Tm (the vapor temperature inside the intake manifold 8) determined based on the output signal from the temperature sensor 16. More specifically, the manifold internal pressure Pm is calculated by multiplying the manifold internal air quantity Cm, a gas constant R, and the intake air temperature Tm, and dividing this product by a manifold volume Vm ($m^3$), as shown in the following Equation 1.

$$Pm = Cm \cdot R \cdot Tm / Vm \qquad \text{Equation 1}$$

The cylinder internal pressure calculation section 22 is configured and arranged to calculate a cylinder internal pressure Pc (Pa) corresponding to the crank angle Ca detected by the crank angle sensor 13. Accordingly, the outflow air quantity Cc(n−1) from the intake manifold 8 and the crank angle Ca are inputted to the cylinder internal pressure calculation section 22. The cylinder internal pressure Pc is calculated by dividing the cylinder internal air quantity Wc (quantity of gas remaining in the cylinder 3) by a cylinder volume Vc ($m^3$), as shown by the following Equation 2. The calculation of the cylinder internal air quantity Wc and the cylinder internal pressure Pc will be discussed in more detail below with referring a flowchart of FIG. 4.

$$Pc = Wc / Vc \qquad \text{Equation 2}$$

The cylinder intake air quantity calculation section 23 is configured and arranged to calculate the cylinder intake air quantity Cc based on the intake air temperature Tm determined based on the output signal from the temperature sensor 16 and the calculation results of the manifold internal pressure Pm in the manifold internal pressure calculation section 21 and the cylinder internal pressure Pc in the cylinder internal pressure calculation section 22. More specifically, the cylinder intake air quantity Cc is calculated by the following Equation 3, using κ as a prescribed value (e.g., specific heat ratio) and Ai as an opening surface area of the intake valve 5.

$$Cc = Ai \cdot Pm \sqrt{\frac{\kappa}{\kappa - 1} \cdot \frac{2}{R \cdot Tm} \left\{ \left(\frac{Pc}{Pm}\right)^{\frac{2}{\kappa}} - \left(\frac{Pc}{Pm}\right)^{\frac{\kappa+1}{\kappa}} \right\}} \qquad \text{Equation 3}$$

As mentioned above, the cylinder intake air quantity Cc calculated here becomes the outflow air quantity from the intake manifold 8, which is used as the previous value Cc(n−1) when the next cylinder intake air quantity Cc is calculated in the next control cycle.

After the cylinder intake air quantity Cc has been calculated, the cylinder intake air quantity Cc is divided by the opening surface area Ai of the intake valve 5 and the gas density ρ inside the cylinder 3 to calculate a cylinder inflow velocity Vi (intake valve passage velocity) as shown by the following Equation 4.

$$Vi = Cc / Ai \cdot \rho \qquad \text{Equation 4}$$

The cylinder inflow velocity Vi can be utilized to estimate a pattern or influence of the peripheral flow (wall flow) of fuel that is adhered on the head portion of the intake valve 5. Thus, by calculating the cylinder inflow velocity Vi, the operation of the internal combustion engine 1 can be effectively controlled by taking the influence of the peripheral flow of fuel into account.

Referring now to a flowchart of FIG. 3, a control flow of the calculation of the cylinder intake air quantity Cc will now be described. The processing described in FIG. 3 is preferably performed at prescribed time intervals.

Figure 3:
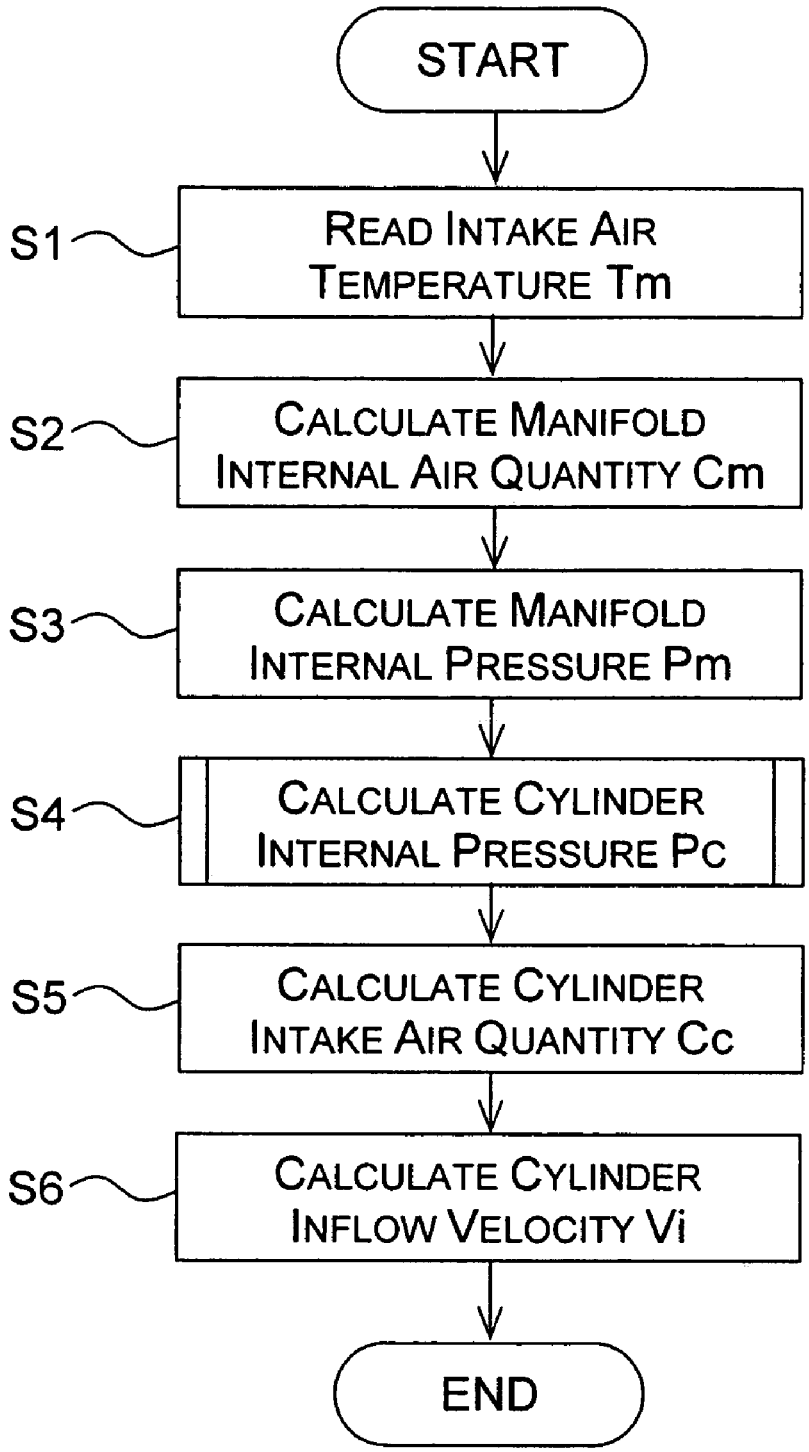
FIG. 3 is a flowchart for calculating a cylinder intake air quantity in the cylinder intake air quantity determination device in accordance with the preferred embodiment of the present invention.

In step S1 of FIG. 3, the intake air temperature Tm inside the intake manifold 8, as detected by the temperature sensor 16, is read by the control unit 12. This step S1 corresponds to a temperature calculation section for calculating the intake air temperature Tm.

In step S2, the manifold internal air quantity Cm inside the intake manifold 8 is calculated based on the balance between the inflow air quantity Qa to the intake manifold 8 and the outflow air quantity Cc(n−1) from the intake manifold 8. The step S2 corresponds to the manifold internal air quantity calculation section 20 in FIG. 2.

In step S3, the manifold internal pressure Pm inside the intake manifold 8 is calculated. The manifold internal pressure Pm is calculated based on the manifold internal air quantity Cm, the intake air temperature Tm, and the manifold volume Vm, as shown by Equation 1 above. The step S3 corresponds to the manifold internal pressure calculation section 21 in FIG. 2.

In step S4, the cylinder internal pressure Pc is calculated based on the cylinder internal air quantity Wc and the cylinder volume Vc, as shown in Equation 2 above. The step S4 corresponds to the cylinder internal pressure calculation section 22 in FIG. 2.

In step S5, the cylinder intake air quantity Cc is calculated based on the intake air temperature Tm, the manifold internal pressure Pm, and the cylinder internal pressure Pc, as shown in Equation 3 above. The step S5 corresponds to the cylinder intake air quantity calculation section 23 in FIG. 2.

In step S6, the cylinder inflow velocity Vi is calculated based on the cylinder intake air quantity Cc and the opening surface area Ai of the intake valve 5, as shown in Equation 4 above. Thus, with the present invention, the cylinder inflow velocity Vi can be calculated with a good precision since the manifold internal pressure Pm inside the intake manifold 8 and the cylinder internal pressure Pc inside the cylinder 3 is taken into account in calculating the cylinder inflow velocity Vi. Moreover, calculating the cylinder inflow velocity Vi allows to take into account the influence of fuel adhering to the head portion of the intake valve 5 after the fuel is injected from the injector valve 11 (i.e., peripheral flow). This step S6 corresponds to a cylinder inflow velocity calculation section of the present invention.

Referring now to a flowchart of FIG. 4, a control flow for the calculation of the cylinder internal pressure Pc (step S4 in FIG. 3) will now be described in more detail. The processing described in FIG. 4 is preferably performed at prescribed time intervals.

Figure 4:
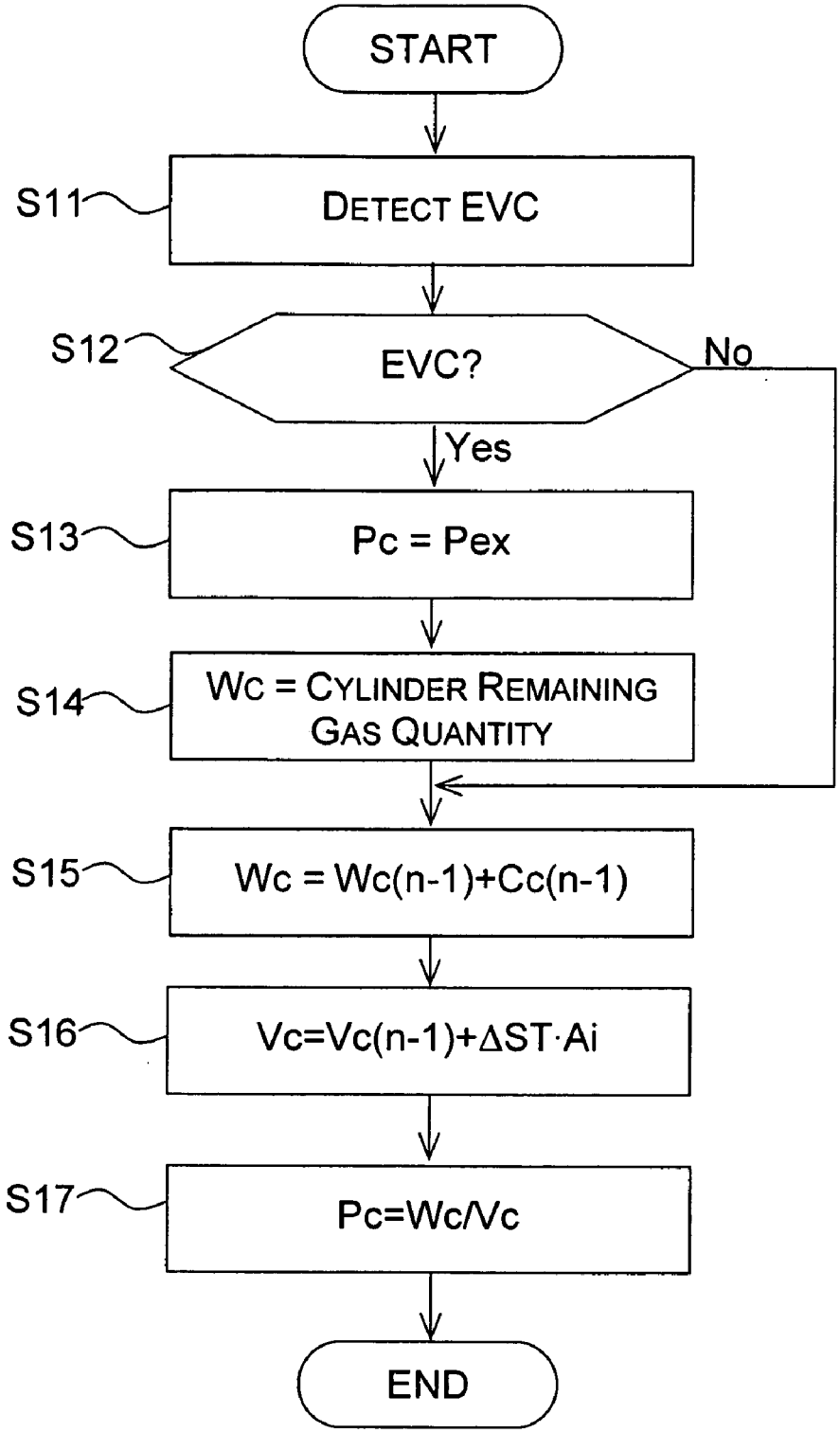
FIG. 4 is a flowchart for calculating a cylinder internal pressure used for calculating the cylinder intake air quantity in the cylinder intake air quantity determination device in accordance with the preferred embodiment of the present invention.

In step S11 of FIG. 4, an exhaust valve closing period EVC corresponding to a period during which the exhaust valve 6 is closed is detected. The exhaust valve closing period EVC can be detected directly by providing a lift sensor to the exhaust valve 6, or based on a valve closing command value controlled by the control unit 12. Moreover, the exhaust valve closing period EVC can be determined based on the signal outputted from the crank angle sensor 13.

In step S12, it is determined whether or not the exhaust valve 6 is in the exhaust valve closing period EVC. If the exhaust valve 6 is in the exhaust valve closing period EVC (i.e., when the exhaust valve 6 is closed), the control proceeds to step S13. If the exhaust valve 6 is not in the exhaust valve closing period EVC (i.e., the exhaust valve 6 is open), the control proceeds to step S15.

In step S13, the cylinder internal pressure Pc is set equal to the exhaust pressure Pex determined based on the output signal from the exhaust pressure sensor 17.

In step S14, the cylinder internal air quantity Wc is set equal to a quantity of gas remaining in the cylinder 3 (an internal EGR quantity). The quantity of gas remaining in the cylinder 3 is preferably calculated, for example, as disclosed in Japanese Patent Application No. 2002-272670. In this reference, a cylinder internal temperature Tc and the cylinder internal pressure Pc during the exhaust valve closing period EVC (i.e., the exhaust valve 6 is closed) are calculated based on the output signals from the exhaust temperature sensor 24, the intake air pressure sensor 25, and the exhaust pressure sensor 17. Then, a gas constant for the exhaust gas corresponding to the air-fuel ratio is calculated. By using the cylinder internal temperature Tc, the cylinder internal pressure Pc and the gas constant, the quantity of gas inside the cylinder 3 is calculated. Moreover, the quantity of blow-back gas during overlap between an open period of the intake valve 5 and an open period of the exhaust valve 6 is calculated based on the output signal from the crank angle sensor 13, the water temperature sensor 26, the intake and exhaust cam angle sensors 27 and 28, and the accelerator pedal sensor 14. The quantity of gas remaining in the cylinder 3 (the internal EGR quantity) is then calculated based on the calculated quantity of gas in the cylinder 3 and the calculated quantity of blow-back gas.

Alternatively, the cylinder internal pressure Pc, then the exhaust gas temperature and the gas constant can be calculated based on the exhaust pressure Pex. The quantity of gas remaining in the cylinder 3 during the exhaust valve closing period EVC can be calculated based at least on the calculated values. Then, the quantity of blow-back gas during overlap can be calculated, and the quantity of gas remaining in the cylinder 3 (the internal EGR quantity) can be calculated based on the quantity of gas in the cylinder 3 and the quantity of blow-back gas.

Alternatively, the quantity of gas in the cylinder 3 during the exhaust valve closing period EVC can be calculated based at least on an estimated temperature inside the cylinder 3 during the exhaust valve closing period EVC, a calculated cylinder internal pressure Pc, and a calculated gas constant. Then, the amount of blow-back gas during the valve overlap is calculated. The estimated temperature inside the cylinder 3 is calculated by calculating the average temperature inside the cylinder 3 when the engine is in a steady state, and imparting a time delay with respect to changes in the average temperature inside the cylinder 3. The quantity of remaining gas in the cylinder 3 is then calculated based on the quantity of gas inside the cylinder 3 and the quantity of blow-back gas.

In step S15, a current cylinder internal air quantity Wc is calculated by adding the inflow air quantity Cc(n−1) calculated in step S5 to a previous value Wc(n−1) of the cylinder internal air quantity Wc.

In step S16, a current cylinder volume Vc is calculated by multiplying a piston crown surface area Ac by a stroke ΔST (a traveling distance) of the piston 2, and adding this product to the previous value Vc(n−1) of the cylinder volume Vc.

In step S17, a current cylinder internal pressure Pc is calculated by dividing the cylinder internal air quantity Wc calculated in step S15 by the cylinder volume Vc calculated in step S16.

Thus, the cylinder intake air quantity determination device of the present embodiment basically comprises the manifold internal air quantity calculation section 20, the manifold internal pressure calculation section 21, the cylinder internal pressure calculation section 22, and the cylinder intake air quantity calculation section 23. The manifold internal air quantity calculation section is configured and arranged to calculate the manifold internal air quantity Cm based on the balance between the inflow air quantity Qa to the intake manifold 8 and the outflow air quantity Cc(n−1) from the intake manifold 8 (step S2 in FIG. 3). The manifold internal pressure calculation section 21 is configured and arranged to calculate the manifold internal pressure Pm based at least on the manifold internal air quantity Cm calculated in the manifold internal air quantity calculation section 20 (step S3 in FIG. 3). The cylinder internal pressure calculation section 22 is configured and arranged to calculate the cylinder internal pressure Pc based at least on one of the cylinder volume Vc, the exhaust pressure Pex, and the cylinder internal air quantity Wc, which are parameters that affect the gas state inside the cylinder 3 (step S4 in FIG. 3 and steps S11 to S17 in FIG. 4). The cylinder intake air quantity calculation section 23 is configured and arranged to calculate the cylinder intake air quantity Cc based on the manifold internal pressure Pm and the cylinder internal pressure Pc (step S5 in FIG. 3). Accordingly, when the cylinder intake air quantity Cc varies, such as when the valve timing changes, or when there is a pressure difference between before and after the intake valve 5 during the low valve lift operation, the cylinder intake air quantity Cc can be calculated with a good precision corresponding to these changes.

The cylinder intake air quantity determination device of the present embodiment further comprises a temperature calculation section (step S1 in FIG. 3) configured and arranged to calculate the intake air temperature Tm based on the output signal from the temperature sensor 16, and the manifold internal pressure calculation section 21 is configured and arranged to calculate the manifold internal pressure Pm based on the manifold internal air quantity Cm and the intake air temperature Tm. Accordingly, the pressure Pm inside the intake manifold 8 can be calculated with a good precision based on the manifold internal air quantity Cm and the intake air temperature Tm. Thus, the cylinder intake air quantity Cc can also be calculated with a good precision.

Moreover, the cylinder intake air quantity determination device of the present embodiment comprises a temperature calculation section (step S1 in FIG. 3) as mentioned above, and the cylinder intake air quantity calculation section 23 is further configured and arranged to calculate the cylinder intake air quantity Cc based on the manifold internal pressure Pm, the cylinder internal pressure Pc, and the intake air temperature Tm. Therefore, the cylinder intake air quantity Cc can be calculated as shown in Equation 3 above.

Also, with the present embodiment, the manifold internal air quantity calculation section 20 is configured and arranged to calculate the inflow air quantity Qa to the intake manifold 8 based on the output signal from the air flow meter 15. Therefore, there is no need to provide a separate measurement apparatus.

Furthermore, the cylinder intake air quantity determination device of the present embodiment also comprises the cylinder inflow velocity calculation section (step S6 in FIG. 3) configured and arranged to calculate the cylinder inflow velocity Vi based on the cylinder intake air quantity Cc calculated by the cylinder intake air quantity calculation section 23. Therefore, the cylinder inflow velocity Vi can be calculated as shown in Equation 4, and the influence of peripheral flow on the head portion of the intake valve 5 can be predicted and taken into account in controlling the operation of the internal combustion engine 1.

As used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The term "detect" as used herein to describe an operation or function carried out by a component, a section, a device or the like includes a component, a section, a device or the like that does not require physical detection, but rather includes determining or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A cylinder intake air quantity determination device comprising:

a manifold internal air quantity calculation section configured to calculate a manifold internal air quantity based on a balance between an air quantity flowing into an intake manifold and an air quantity flowing out of the intake manifold;

a manifold internal pressure calculation section configured to calculate a manifold internal pressure based at least on the manifold internal air quantity;

a cylinder internal pressure calculation section configured to calculate a cylinder internal pressure based on at least one parameter that affects a vapor state inside a cylinder; and a cylinder intake air quantity calculation section configured to calculate a cylinder intake air quantity based on the manifold internal pressure and the cylinder internal pressure.

2. The cylinder intake air quantity determination device according to claim 1, wherein the cylinder internal pressure calculation section is further configured to use at least one of a cylinder volume, an exhaust pressure and a cylinder internal air quantity as the at least one parameter that affects the vapor state inside the cylinder.

3. The cylinder intake air quantity determination device according to claim 1, further comprising a temperature calculation section configured to calculate an intake air temperature, and the manifold internal pressure calculation section being further configured to calculate the manifold internal pressure based on the manifold internal air quantity and the intake air temperature.

4. The cylinder intake air quantity determination device according to claim 1, further comprising a temperature calculation section configured to calculate an intake air temperature, and the cylinder intake air quantity calculation section being further configured to calculate the cylinder intake air quantity based on the manifold internal pressure, the cylinder internal pressure, and the intake air temperature.

5. A cylinder intake air quantity determination device according to claim 1, wherein the manifold internal air quantity calculation section is further configured to calculate the air quantity flowing into the intake manifold by using an output signal from an air flow meter.

6. The cylinder intake air quantity determination device according to claim 1, further comprising a cylinder inflow velocity calculation section configured to calculate a cylinder inflow velocity based on the cylinder intake air quantity.

7. The cylinder intake air quantity determination device according to claim 2, further comprising a temperature calculation section configured to calculate an intake air temperature, and the manifold internal pressure calculation section being further configured to calculate the manifold internal pressure based on the manifold internal air quantity and the intake air temperature.

8. The cylinder intake air quantity determination device according to claim 7, further comprising a temperature calculation section configured to calculate an intake air temperature, and the cylinder intake air quantity calculation section being further configured to calculate the cylinder intake air quantity based on the manifold internal pressure, the cylinder internal pressure, and the intake air temperature.

9. The cylinder intake air quantity determination device according to claim 8, wherein the manifold internal air quantity calculation section is further configured to calculate the air quantity flowing into the intake manifold by using an output signal from an air flow meter.

10. The cylinder intake air quantity determination device according to claim 9, further comprising a cylinder inflow velocity calculation section configured to calculate a cylinder inflow velocity based on the cylinder intake air quantity.

11. A cylinder intake air quantity determination device comprising:

manifold internal air quantity calculation means for calculating a manifold internal air quantity based on a balance between an air quantity flowing into an intake manifold and an air quantity flowing out of the intake manifold;

manifold internal pressure calculation means for calculating a manifold internal pressure based at least on the manifold internal air quantity;

cylinder internal pressure calculation means for calculating a cylinder internal pressure based on at least one parameter that affects a vapor state inside a cylinder; and cylinder intake air quantity calculation means for calculating a cylinder intake air quantity based on the manifold internal pressure and the cylinder internal pressure.

12. The cylinder intake air quantity determination device according to claim 11, wherein the cylinder internal pressure calculation means is further configured to use at least one of a cylinder volume, an exhaust pressure and a cylinder internal air quantity as the at least one parameter that affects the vapor state inside the cylinder.

13. A method of determining a cylinder intake air quantity of an internal combustion engine comprising:

calculating a manifold internal air quantity based on a balance between an air quantity flowing into an intake manifold and an air quantity flowing out of the intake manifold;

calculating a manifold internal pressure based at least on the manifold internal air quantity;

calculating a cylinder internal pressure based on at least one parameter that affects a vapor state inside a cylinder; and calculating a cylinder intake air quantity based on the manifold internal pressure and the cylinder internal pressure.

14. The method of determining a cylinder intake air quantity according to claim 13, wherein the calculating of the cylinder internal pressure uses at least one of a cylinder volume, an exhaust pressure and a cylinder internal air quantity as the at least one parameter that affects the vapor state inside the cylinder.

* * * * *